United States Patent [19]

Cunningham

[11] 4,152,239

[45] May 1, 1979

[54] BIPOLAR ELECTROLYZER

[75] Inventor: Hugh Cunningham, Corpus Christi, Tex.

[73] Assignee: PPG Industries, Inc., Pittsburgh, Pa.

[21] Appl. No.: 884,776

[22] Filed: Mar. 8, 1978

Related U.S. Application Data

[62] Division of Ser. No. 716,311, Aug. 20, 1976, Pat. No. 4,093,525.

[51] Int. Cl.[2] ..... C25B 9/04

[52] U.S. Cl. ..... 204/254

[58] Field of Search ..... 204/254–256

[56] References Cited

U.S. PATENT DOCUMENTS

| | | | |
|---|---|---|---|
| 3,755,105 | 8/1973 | Messner | 204/95 |
| 3,809,630 | 5/1974 | De Nora et al. | 204/98 |
| 3,945,909 | 3/1976 | Giacopelli | 204/254 |
| 4,059,500 | 11/1977 | Kamarian | 204/254 |
| 4,064,031 | 12/1977 | Kamarian | 204/254 |

*Primary Examiner*—R. L. Andrews

*Attorney, Agent, or Firm*—Richard M. Goldman

[57] ABSTRACT

Disclosed is a method of conducting electrolysis in a bipolar electrolyzer. According to the disclosed method an electrical current is passed from anodes of a first electrolytic cell through an electrolyte to cathodes of the first electrolytic cell, evolving hydrogen at the cathodes. The electrical current then passes from the cathode of the cell through a bipolar unit to the anodes of a subsequent cell in the electrolyzer. The disclosed method is characterized in that the electrical current passes from the cathodes of the first cell through the bipolar unit to the anodes of the subsequent cell by first changing direction and passing laterally through a cathodic element of the backplate to conductor means between the cells, thereafter changing direction and passing through the conductor means, and then changing direction and passing laterally through the anodic element of the backplate to the anodes of the subsequent cell. Also disclosed is a bipolar electrolyzer containing a plurality of individual electrolytic cells electrically and mechanically in series. Each of the cells have anodes and cathodes, with the cathodes of one cell being separated from the anodes of the next adjacent cell in the electrolyzer by a backplate. The electrolyzer is characterized in that the backplate has separate anodic and cathodic members with the anodic and cathodic members being spaced from each other, and conductor means which are offset from both the anodes and the cathodes of the cell. In this way the electrical current changes direction four times, i.e., the electrical current must pass from the cathodes of the first cell laterally thereto, to conductor means and then from the conductor means, laterally thereto, to the anodes of the subsequent cell in the electrolyzer.

3 Claims, 8 Drawing Figures

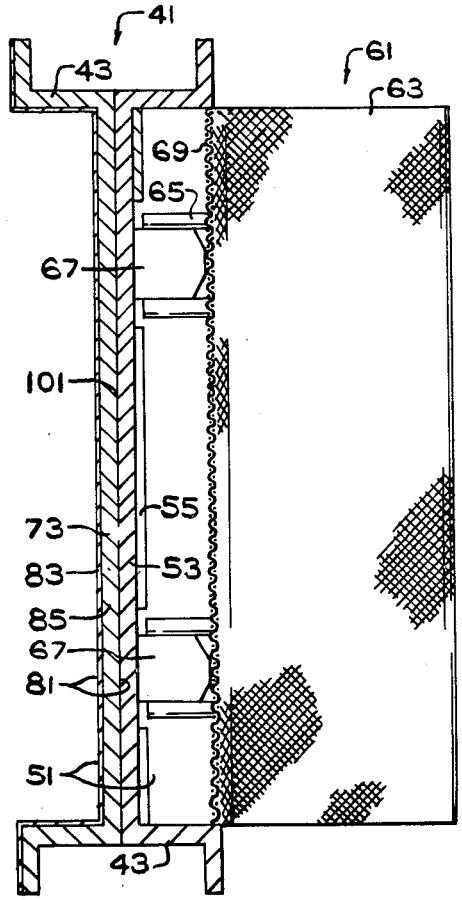
Fig. 4
Fig. 3
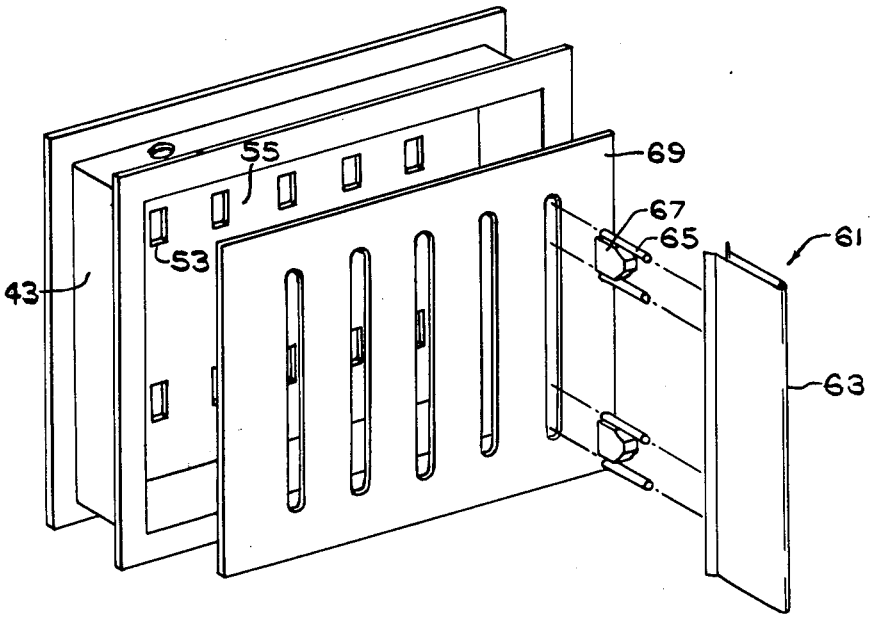

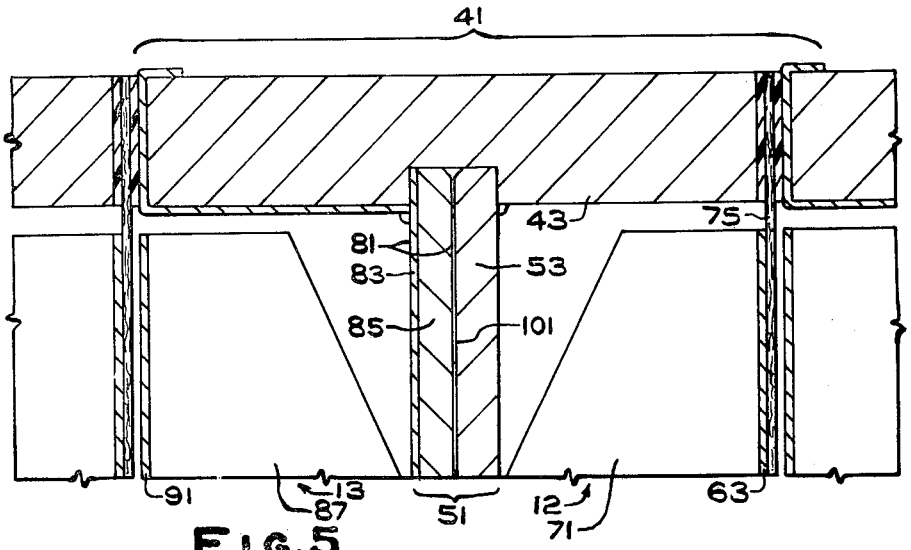
FIG. 5
FIG. 6
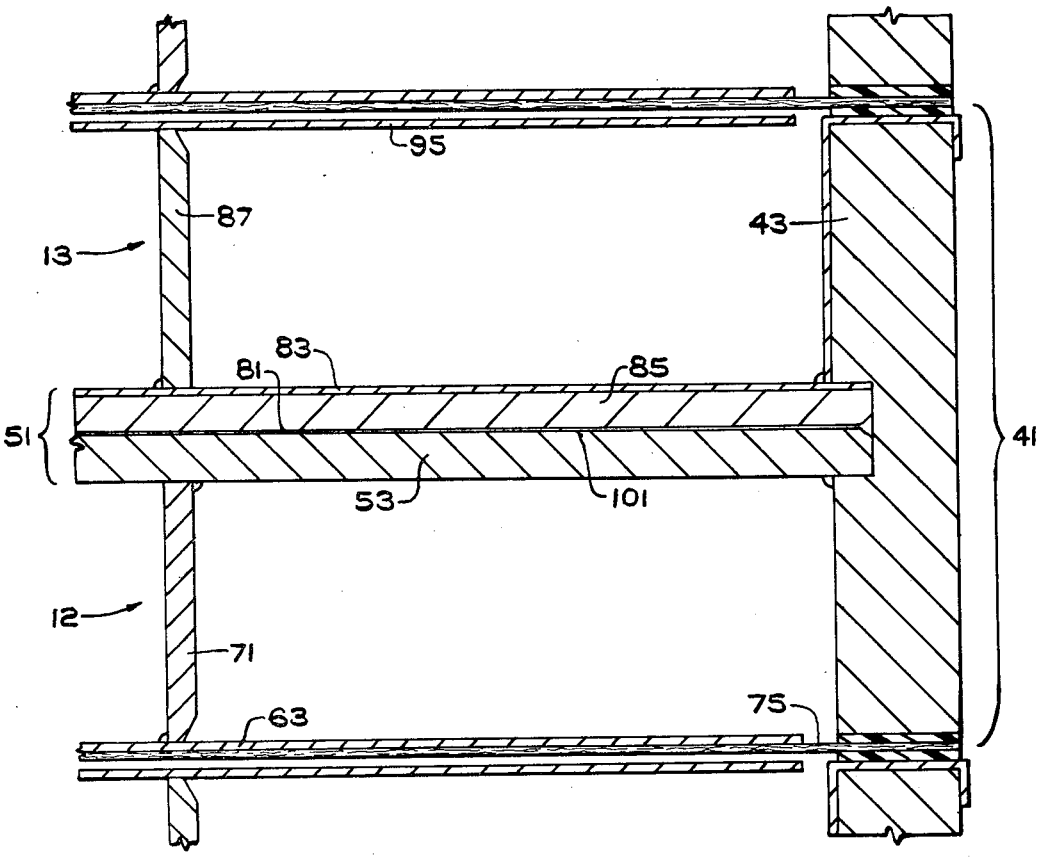

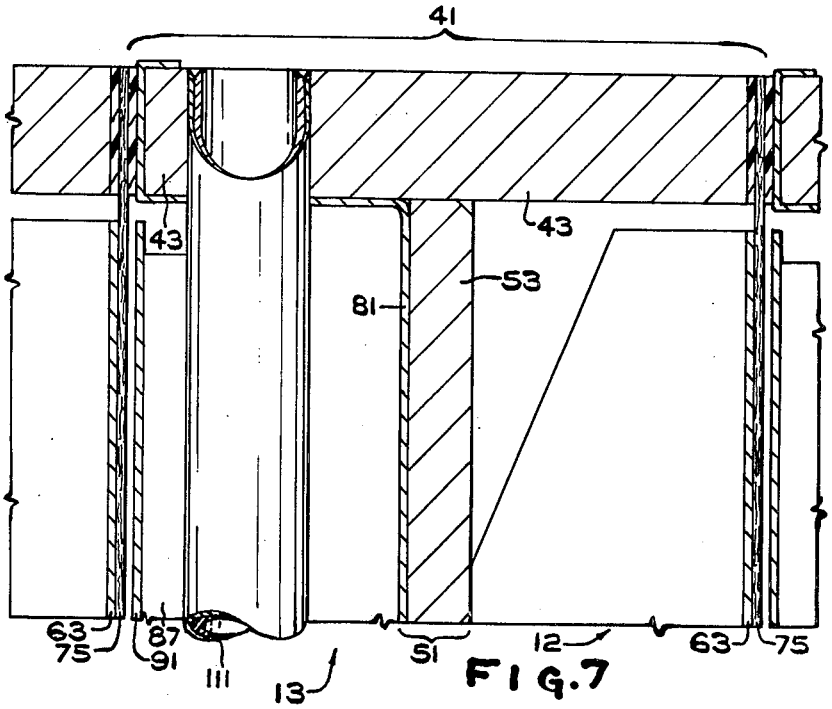
FIG. 7
FIG. 8
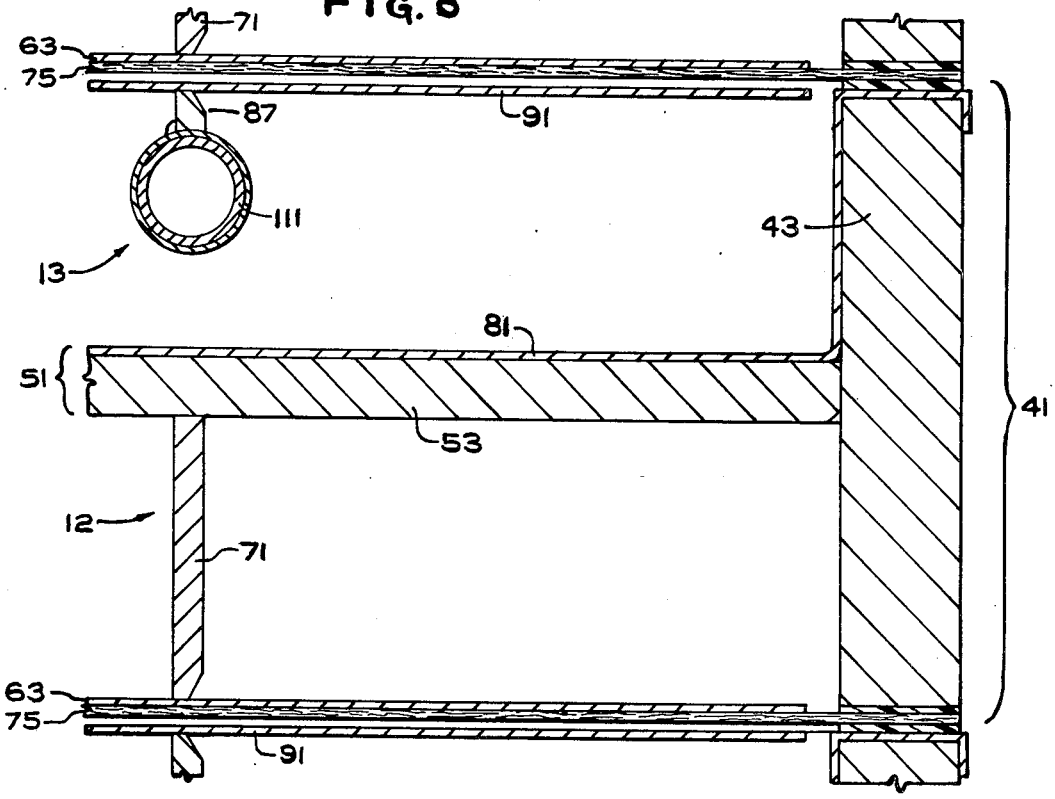

BIPOLAR ELECTROLYZER

This is a division of application Ser. No. 716,311 filed Aug. 20, 1976 now U.S. Pat. No. 4,093,525.

DESCRIPTION OF THE INVENTION

Alkali metal hydroxide, hydrogen, and chlorine may be produced in diaphragm cells, including permionic membrane equipped cells. In such cells there are two electrolyte compartments. One compartment is the catholyte compartment. The other compartment is the anolyte compartment. The two compartments are separated by a barrier, for example an electrolyte permeable diaphragm of asbestos, or an electrolyte impermeable but ion permeable barrier, for example, of permionic membrane.

Such cells may be electrically connected in series in a common housing with the anodes of one cell being electrically in series with the cathodes of the prior cell and mounted on the opposite sides of a common structural member. In this way the cathodes of one cell are in series with the anodes of the next adjacent cell in the electrolyzer and mounted on a common structural member, and the anodes of the cell are in series with the cathodes of the prior cell in the electrolyzer. Such a configuration is called a bipolar configuration.

An electrolyzer is an assembly of electrolytic cells in bipolar configuration. The common structural member is called a bipolar unit or bipolar electrode. The common structural member includes the backplate, the anodes of one cell in the electrolyzer and the cathodes of the next adjacent cell in the electrolyzer connected thereto. The electrolytic cell provided by the anodes of one bipolar electrode facing the cathodes of the adjacent bipolar electrode and facing each other so that electrolysis of electrolyte may be carried out therebetween is called a bipolar cell.

Bipolar electrolyzers are described in the article by Kircher, "Electrolysis of Brines in Diaphragm Cells," in Sconce, Chlorine, Reinholt Publishing Corp., New York, New York (1962).

Bipolar electrolyzers provide economy of materials of construction and plant space. However, in order to take advantage of the apparent economies of bipolar electrolyzers, electrolysis should be conducted at high current densities, for example above about 120 Amperes per square foot or even above about 190 Amperes per square foot. When electrolysis is carried out at such current densities it is important that the electrical current flow through the electrolyzer with minimun electrical resistance between adjacent cells in the electrolyzer. It is also important that the seepage of electrolyte into the backplates be completely prevented.

In early bipolar electrolyzers, the flow of electricity through the backplate was enhanced by providing metal to metal contact between the titanium of the anolyte surface of the backplate and the steel of the catholyte resistant surface of the backplate, for example as in explosion bonded backplates. In other bipolar electrolyzer designs, electrically conductive structures in the backplate carried the current from the cathodes through the backplate to the anodes connected thereto. One way this was accomplished was by the use of copper studs which extended through the backplate.

However, it was soon found that in bipolar electrolyzers having steel-titanium laminate backplates the atomic hydrogen generated on the steel cathodic surface of the backplate migrated through the steel toward the titanium member of the backplate. This resulted in the formation of titanium hydride at the interface between the steel and the titanium. One solution of this problem is shown in U.S. Pat. No. 3,759,813 to Carl W. Raetzsch et al for an "Electrolytic Cell" and U.S. Pat. No. 3,849,280 to Carl W. Raetzsch et al for "Electrolytic Cell Including Means for Preventing Atomic Hydrogen Attack of the Titanium Backplate Member." As described therein means are provided in combination with the cathodic surface of the backplate to prevent the entrance of hydrogen into the steel or alternatively to vent the hydrogen from between the steel and the titanium.

It has now been found that if the flow of electrical current through the backplate can be caused to be lateral, i.e., perpendicular, to the overall flow of electrical current from the first anodic half cell of the electrolyzer, the hydrogen diffusion toward and into the titanium may be substantially reduced. The formation of titanium hydride is further diminished if the anodic member of the backplate is spaced from the cathodic member of the backplate and the conducting means are at the periphery of the backplate.

According to the method of this invention this may be accomplished by passing the electrical current from the cathodes of the first cell of a pair of cells through the backplate toward the conductor means in a direction lateral to the overall flow of current through the electrolyzer, thereafter passing the electrical current through the conductor means, and then passing the current through the backplate to the anodes laterally to the direction of the overall flow of current. This may be carried out in a bipolar electrolyzer where the backplate has an anodic member and a separate cathodic member, with conductor means offset from the anodes and cathodes so that electrical current passes from the cathodes of the first cell laterally to the direction of the overall flow of electrical current through the cell, to conductor means, through the conductor means, and then, laterally to the direction of the overall flow of current, to the anodes of the subsequent cell.

DESCRIPTION OF THE DRAWINGS

FIG. 3 is an exploded perspective view, toward the cathodes, of an individual cell of the electrolyzer shown in FIG. 1.

FIG. 4 is a cut away side elevation of a bipolar unit of the electrolyzer shown in FIGS. 1, 2, and 3.

FIG. 5 is a cut away elevation view of a backplate of an alternative exemplification wherein the anodic and cathodic elements are joined at the peripheral wall of the electrolyzer.

FIG. 6 is a cut away plan view of the exemplification shown in FIG. 5 wherein the anodic and cathodic elements are joined at the peripheral wall.

FIG. 7 is a cut away elevation view of a bipolar unit of still another exemplification of the structure of this invention wherein the current flows from an electrode through means joined to the peripheral directly to the peripheral walls and thence to the backplate and the next adjacent electrode.

FIG. 8 is a cut away plan view of the exemplification of FIG. 7.

DETAILED DESCRIPTION OF THE INVENTION

Figure 1:
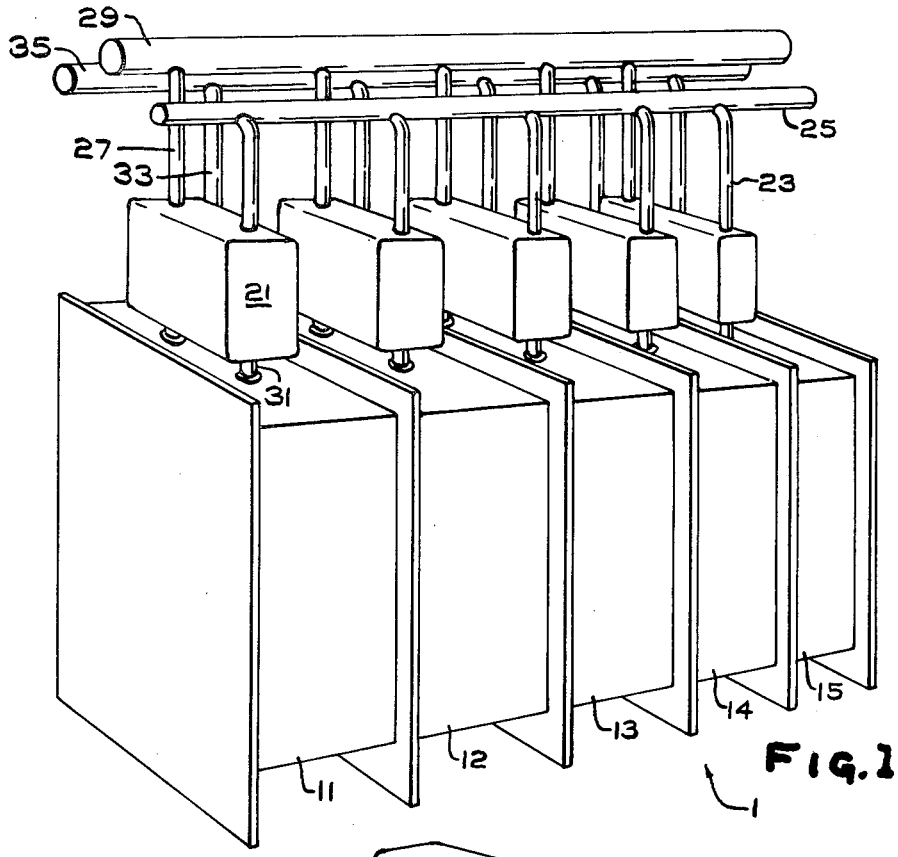
FIG. 1 is a perspective view of a portion of a bipolar electrolyzer.
Figure 2:
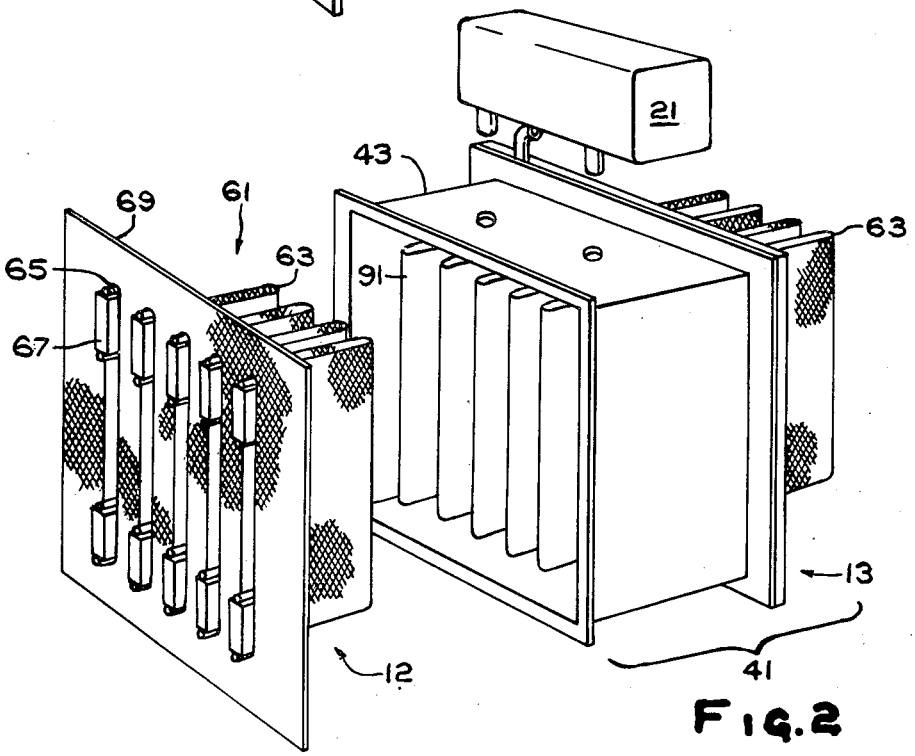
FIG. 2 is an exploded perspective view, toward the anodes, of an individual cell of the electrolyzer shown in FIG. 1.

A bipolar electrolyzer (1) is shown in FIG. 1 and an individual cell thereof is shown in FIGS. 2 and 3. The bipolar electrolyzer (1) has a plurality of individual electrolytic cells (11 through 15) electrically and mechanically in series, with an anodic end cell (11) at one end of the electrolyzer (1) and a cathodic end cell (15) at the opposite end of the electrolyzer (1). Intermediate cells (12 through 14) are between the anodic end cell (11) and the cathodic cell (15) of the electrolyzer (1).

On top of the electrolyzer (1) are the brine tanks (21). Brine is fed from a brine header (25) through brine lines (23) to the brine tanks (21) and from the brine tanks (21) to the individual electrolytic cells (11 through 15). The brine tanks (21) also receive chlorine gas from the individual cells (11 through 15) through lines (31) to the brine tank and discharge chlorine from the brine tank (21) through chlorine lines (27) to the chlorine header (29).

Hydrogen is recovered from the individual cells (11 through 15) through hydrogen lines (33) that lead to the hydrogen header (35). Liquid catholyte product, for example a cell liquor of potassium chloride and potassium hydroxide in a diaphragm cell having a potassium chloride feed, or a cell liquor of sodium chloride and sodium hydroxide in a diaphragm cell having sodium chloride feed, or sodium hydroxide in a permionic membrane equipped cell having sodium chloride feed, is recovered from the cells through catholyte recovery means, i.e., cell liquor perc pipes. The effluent of the cell liquor perc pipes is collected in a cell liquor trough.

In the operation of a bipolar electrolyzer an electrical current passes from the anodes of the first electrolytic cell through electrolyte to cathodes of the first electrolytic cell, evolving chlorine on the anodes, hydrogen on the cathodes, and alkali metal hydroxide in the catholyte liquor. The electrical current then passes from the cathode of one cell to the anodes of the next adjacent cell in the electrolyzer.

According to the method of this invention the electrical current typically will undergo four changes of direction. First, the current will change direction from the direction of the overall resultant flow of current from the one cell to the next, i.e., the vector flow of current, to a direction lateral thereto. Second, when the electrical current encounters a conductor means, as will be described more fully hereinafter, the direction of flow of the current will generally be in the parallel to the vector flow. Third, as the current passes from the conductor through the anodic element of the backplate, the current will again change direction to a direction lateral to the vector flow of current. Fourth, as the current enters the anode of the next adjacent cell in the electrolyzer, it will return to the direction of the vector flow of current. In this way an indirect path is provided for the electrical current.

By the vector direction of flow of current is meant the direction of flow of current from the anodic half unit at one end of the electrolyzer to the cathodic half unit at the opposite end of the electrolyzer.

The change in direction from the cathode through the cathodic element of the backplate to the conductor may be accomplished by passing the current laterally through the cathodic element of the backplate to a peripheral conductor. Alternatively it may be accomplished by offset conductor means that pass through the cathodic element of the backplate to the anodic element of the backplate. While flowing through the cathodic element of the backplate the current is flowing laterally to the vector direction of the current flow.

The direction of the flow of the current through the conductor means will generally be in the vector direction of flow of electrical current through the cell. This may be accomplished by causing the current to pass through either peripheral walls of the electrolyzer to the anodic element of the backplate, or through offset conductor means within the cell body to the anodic element.

When the current leaves the conductor, it is caused to flow to the anodes of the next adjacent cell laterally to the vector direction of the current flow.

According to a further exemplification of this invention the conductor may be in the periphery of the cell body and the current may be caused to pass directly from the periphery of the cell body through anode supports to the anode. Such supports may be cell peripheral wall to cell peripheral wall members to which the anodes are joined.

According to a further exemplification of this invention current may be caused to pass from the cathodes through means electrically joining the cathode and cathode backscreen directly to the peripheral walls of the cell and thence from the peripheral walls of the cell laterally through the anodic element of the backplate to the anodes of the next adjacent cell in the electrolyzer.

The backplate (51) has anodic (81) and cathodic (53) elements. According to this invention the anodic (81) and cathodic (53) elements of the backplate (51) are electrically insulated from each other over a major portion of their respective areas. That is, they may be spaced from each other with only limited areas of electrical contact therebetween. Typically reverse sites of the portions of the elements exposed to electrolyte may be spaced from each other, or the reverse sides of the electrode bearing portions of the backplate elements may be spaced from each other. The electrical contact may then be provided by offset conductors, either within the backplate or at the peripheral walls of the electrolyzer.

The backplate (51) includes conductor means offset from the anodes (61) and cathodes (91). This is so that the current first flows laterally to the overall vector flow of current through the electrolyzer, then parallel to the overall vector flow of current through the electrolyzer, and finally laterally to the overall vector flow of current through the electrolyzer, back to the cathode.

One structure useful in carrying out the method of this invention is illustrated in FIGS. 2, 3, and 4. As there shown a bipolar unit (41) has the cathodes (61) of the prior cell (12) of the electrolyzer (1), the anodes (91) of the subsequent cell (13) of the electrolyzer (1) and a peripheral wall (43). Also shown are the cathodes (61) of the subsequent cell (13) in the electrolyzer (1).

The anodic element (81) of the bipolar unit includes a steel member (85) and a titanium member (83). The two members (85) and (83) may be explosively bonded to each other. The cathodic element (53) includes a steel member (53) and a compressive member (55) joined to the steel member (53) by a welded joint (73). The cathodes (61) include cathode fingers (63), cathode bases (67), cathode studs (65), and a cathodic backscreen (69).

The compressive means (55), i.e., a plate or sheet, is welded to the steel surface (85) of the anodic unit (81), in this way holding the cathodic unit (51) to the steel surface (85) of the anodic unit (81). As shown in the exemplification in FIGS. 2, 3, and 4 the electrical current passes from the cathodes (63) through the studs (65) to the cathodic member (53) of the backplate (51) where its direction is changed to a direction lateral to the overall vector flow of current through the electrolyzer (1). The hydrogen, however, diffuses through the cathodic member (53) to a void between cathodic member (53) and anodic member (85), where it vents to the atmosphere. The current then flows through the cathodic portion (53) of the backplate (51) to the welded joint (73). Thereafter the current flows through the joint (73) in a direction parallel to the overall vector flow of current, thence laterally to the direction of overall vector flow of current through the anodic element (81) of the backplate (51) to the anodes (91).

An alternative exemplification of this invention is shown in FIGS. 5 and 6. As there shown the bipolar unit (41) has an anode (91) spaced from the anodic element (81) of the backplate (51) on a support (87), and a cathode (63) spaced from the cathodic element (53) of the backplate (51) on a support (71). The cathode (63) may have a diaphragm or membrane (75) thereon.

The backplate (57) includes an anodic member (81) of either steel (85) and titanium (83) with the titanium (83) exposed to the anolyte or, in an alternative exemplification, only titanium. The bipolar unit (41) further includes a peripheral wall (43). Electrical current passes from cathode (63) through the support (71) to the cathodic unit (53), laterally to the peripheral wall (43), through the peripheral wall (43) as a conductor displaced or offset from the anodes (91) and cathodes (63) to the anodic element (81) of the backplate (51), thence laterally through the anodic element (81) of the backplate (51) to the anode support (87), and then to the anodes (81). Thus, according to the exemplification shown in FIGS. 5 and 6 the conductor means is the peripheral wall (43) of the electrolytic cell. There may, additionally, be an insulating barrier (101) between the anodic member (81) and the cathodic member (53) of the backplate (51).

According to a still further exemplification of this invention, shown in FIGS. 7 and 8, the electrode support may be spaced from the backplate (51), extending from one peripheral wall (43) to the opposite peripheral wall (43). As shown in FIGS. 7 and 8, the bipolar unit (41) includes an anode (91) and a cathode (63) separated by an iron-titanium backplate (57) and surrounded by a peripheral wall (43). The cathode (63) is supported by a support member (71) extending outwardly from the backplate (51) while the anode (91) depends from a conductive support (111) spaced from the backplate (51) and extending from the peripheral wall (43) to opposite peripheral wall (43). In the exemplification shown in FIGS. 7 and 8 a valve metal clad conductor (111), e.g., a titanium clad copper member, extends from the top (43) of the cell to the bottom, with a member (87) extending therefrom and supporting the anode (91). In the exemplification shown in FIGS. 7 and 8 electrical current flows from the cathode (63) of a cell (12) to the backplate (51), thence in a direction lateral to the overall vector flow to the peripheral wall (43), and through the peripheral wall (43) to the conductive support (111) thence through the conductive support (111) to the anode (91) of the next adjacent cell (13) in the electrolyzer (1).

According to this invention the anodic and cathodic of the elements of the backplate are electrically insulated from each other of a major portion of their respective surfaces, e.g., 99 percent or more. They may, additionally be physically separated from each other. For example, an electrically insulating barrier such as a ceramic, or a polymer, for example polymer film with high enough breakdown potential to withstand a 0.2 to 0.5 volt potential over a period of several years, may be provided between the anodic element and cathodic element of the backplate.

While the invention has been described with reference to particular exemplifications and embodiments thereof, it is not intended to so limit the scope of the invention except as insofar as specific details as recited in the appended claims.

I claim:

1. In a bipolar electrolyzer comprising a plurality of individual electrolytic cells electrically and mechanically in series, each of said cells having anodes and cathodes and an external peripheral wall, the cathodes of one cell being separated from the anodes of the next adjacent cell in the electrolyzer by backplate means therebetween; the improvement wherein said backplate means comprises: an anodic member and a cathodic member, said anodic and cathodic members being spaced from each other; and conductor means electrically connecting said anodes and said cathodes through said external peripheral wall.

2. In a bipolar electrolyzer comprising a plurality of individual electrolytic cells electrically and mechanically in series, each of said cells having an external peripheral wall and anodes and cathodes, the cathodes of one cell being separated from the anodes of the next adjacent cell in the electrolyzer by backplate means therebetween; the improvement wherein said backplate means comprises: an anodic member and a cathodic member, said anodic and cathodic members being spaced from each other; and conductor means electrically connecting said anodic member and said cathodic member of the backplate through said external peripheral wall.

3. The bipolar electrolyzer of claim 2 wherein said backplate comprises insulating means interposed between said anodic element and said cathodic element.

* * * * *